US011493269B2

(12) United States Patent
Caswell et al.

(10) Patent No.: US 11,493,269 B2
(45) Date of Patent: Nov. 8, 2022

(54) BEVERAGE CHILLER AND ASSOCIATED SYSTEMS AND METHODS

(71) Applicant: ROASTING PLANT, INC., New York, NY (US)

(72) Inventors: Michael Robert Caswell, New York, NY (US); Michael Hodor, New York, NY (US); David H. Phillips, Palm Beach Gardens, FL (US)

(73) Assignee: Roasting Plant, Inc., New York, NY (US)

( * ) Notice: Subject to any disclaimer, the term of this patent is extended or adjusted under 35 U.S.C. 154(b) by 0 days.

(21) Appl. No.: 15/505,310

(22) PCT Filed: Aug. 21, 2015

(86) PCT No.: PCT/US2015/046291
§ 371 (c)(1),
(2) Date: Feb. 21, 2017

(87) PCT Pub. No.: WO2016/029112
PCT Pub. Date: Feb. 25, 2016

(65) Prior Publication Data

US 2018/0216875 A1 Aug. 2, 2018

Related U.S. Application Data

(60) Provisional application No. 62/040,651, filed on Aug. 22, 2014.

(51) Int. Cl.
*F25D 31/00* (2006.01)
*B67D 3/00* (2006.01)
(Continued)

(52) U.S. Cl.
CPC ..... *F25D 31/002* (2013.01); *B67D 3/00* (2013.01); *B67D 3/0009* (2013.01);
(Continued)

(58) Field of Classification Search
CPC ..... F25D 31/002; F25D 31/003; F25D 17/02; F25D 2331/811; F25D 2303/081;
(Continued)

(56) References Cited

U.S. PATENT DOCUMENTS 719,212 A * 1/1903 Guttenberg ..... F25D 23/12 62/331
869,745 A * 10/1907 Spencer ..... F25D 31/002 62/399
(Continued)

FOREIGN PATENT DOCUMENTS

GB 2475244 A * 5/2011 ..... B67D 3/0009
JP 46-022271 Y1 8/1971
(Continued)

OTHER PUBLICATIONS

Supplementary European Search Report for Application No. 15834453.1, dated Mar. 8, 2018. 8 pages.
(Continued)

*Primary Examiner* — Eric S Ruppert
*Assistant Examiner* — Kirstin U Oswald
(74) *Attorney, Agent, or Firm* — McCarter & English, LLP

(57) ABSTRACT

Exemplary embodiments are generally directed to beverage chillers for chilling a hot beverage so that the hot beverage can be served as a chilled beverage in real time on demand fashion. The beverage chillers include a beverage collection section, a heat exchanger section, and a dispensing section fluidically connected relative to each other. The beverage collection section receives a beverage in a hot state. The heat exchanger section chills the beverage from the hot state to a predetermined chilled temperature. The dispensing section dispenses the beverage at or near the predetermined chilled temperature. Exemplary embodiments are also directed to
(Continued)

methods and systems for chilling a hot beverage in real time on demand fashion.

22 Claims, 9 Drawing Sheets

(51) Int. Cl.
*B67D 7/80* (2010.01)
*F25D 17/02* (2006.01)
*F28D 1/02* (2006.01)

(52) U.S. Cl.
CPC ..... *F25D 31/003* (2013.01); *B67D 7/80* (2013.01); *F25D 17/02* (2013.01); *F25D 2303/081* (2013.01); *F25D 2331/811* (2013.01); *F28D 1/0213* (2013.01)

(58) Field of Classification Search
CPC ..... F25D 29/00; B67D 3/00; B67D 3/0009; B67D 7/80; F28D 1/0213; F25B 21/02; F25B 2321/023
USPC ..... 62/98
See application file for complete search history.

(56) References Cited

U.S. PATENT DOCUMENTS 986,276 A * 3/1911 Freeman ..... F28D 7/024 165/163
1,607,347 A * 11/1926 Hemman ..... F25D 31/002 62/460
1,645,000 A * 10/1927 Hassensall ..... B67D 3/0038 62/399
1,702,560 A * 2/1929 Ebinger ..... F25D 31/002 62/391
1,711,494 A * 5/1929 Giese ..... F25D 3/06 62/391
1,836,893 A * 12/1931 Harry ..... B67D 3/0003 222/362
1,861,033 A * 5/1932 Sundeen ..... F25D 31/002 62/526
1,907,641 A * 5/1933 Askin ..... F25D 31/002 165/169
1,989,588 A * 1/1935 Cullen ..... F25D 31/002 62/395
2,023,373 A * 12/1935 Notar ..... B67D 3/048 222/133
2,056,800 A * 10/1936 Mohn ..... F25D 31/002 62/391
2,113,972 A * 4/1938 Adams ..... F25D 3/02 261/76
2,144,004 A * 1/1939 Wilson ..... F25D 31/002 165/47
2,169,387 A * 8/1939 Hann ..... F25D 31/002 62/383
2,186,900 A * 1/1940 Dick ..... F25D 31/002 62/297
2,230,905 A * 2/1941 Popky ..... F25D 31/002 62/393
2,276,964 A * 3/1942 Grove ..... F25D 31/002 62/391
2,278,225 A * 3/1942 Taylor ..... F25D 31/003 62/394
2,339,082 A * 1/1944 Kromer ..... F25D 31/002 137/340
2,555,682 A * 6/1951 Daun ..... F25D 31/002 165/169
2,594,502 A * 4/1952 Sahs ..... F25D 31/002 62/201
2,607,519 A * 8/1952 Sanborn ..... B67D 3/0009 222/129
2,630,259 A * 3/1953 Stein ..... F25D 31/002 62/391
2,801,529 A * 8/1957 Meltesen ..... F25D 11/02 62/394
3,120,742 A * 2/1964 Denisoff ..... F25D 31/003 62/434
3,822,565 A * 7/1974 Arzberger ..... G07F 13/025 62/394
3,843,020 A * 10/1974 Bardeau ..... B67D 1/0085 222/58
3,888,092 A * 6/1975 Fisher ..... F25D 17/02 62/433
3,952,538 A * 4/1976 Warlick ..... A23G 9/106 366/144
3,995,441 A * 12/1976 McMillin ..... B67D 1/07 62/177
4,008,832 A * 2/1977 Rodth ..... B67D 1/0861 62/138
4,036,621 A * 7/1977 Burton ..... F28D 7/024 165/172
4,044,754 A * 8/1977 Cronin ..... F24S 10/504 137/59
4,055,279 A * 10/1977 Lapera ..... B67D 7/80 219/202
4,124,994 A * 11/1978 Cornelius ..... F25D 31/003 62/138
4,204,613 A * 5/1980 Terzian ..... B67D 3/0009 165/169
4,238,053 A * 12/1980 Bonini ..... B67D 3/0009 222/401
4,403,573 A * 9/1983 Cauchy ..... F24B 9/00 126/513
4,407,356 A * 10/1983 DeLau ..... F28D 1/0213 165/169
4,448,036 A * 5/1984 Iannelli ..... B67D 1/0864 62/392
4,476,690 A * 10/1984 Iannelli ..... F25D 31/002 62/395
4,494,600 A * 1/1985 DeLau ..... B67D 3/00 165/DIG. 348
4,549,512 A 10/1985 Takao et al.
4,599,872 A * 7/1986 Rist ..... F25D 3/08 62/399
4,624,395 A * 11/1986 Baron ..... A47J 31/401 D7/308
4,809,594 A 3/1989 Vitous
4,856,678 A * 8/1989 Stanfill ..... B67D 1/0857 62/396
4,996,847 A * 3/1991 Zickler ..... B67D 3/0029 62/394
5,080,261 A * 1/1992 Green ..... B67D 1/0857 222/131
5,191,773 A * 3/1993 Cassell ..... F25D 17/02 62/392
5,280,711 A * 1/1994 Motta ..... F25D 31/003 62/177
5,319,947 A * 6/1994 Fischer ..... B67D 1/0857 62/389
5,335,705 A * 8/1994 Morishita ..... B67D 1/04 222/61
5,337,779 A * 8/1994 Fukuhara ..... F16T 1/00 137/392
5,421,159 A * 6/1995 Stokes ..... B67D 3/0035 62/394
5,537,838 A * 7/1996 Mills ..... B67D 1/0864 62/400
5,572,883 A * 11/1996 Roberts ..... F25D 16/00 165/110
5,617,736 A * 4/1997 Ito ..... B67D 1/0864 62/393
6,112,946 A * 9/2000 Bennett ..... B67D 1/0009 222/64
6,357,520 B1 3/2002 Kato et al.
6,540,926 B2 * 4/2003 Goodrich ..... B01D 17/0208 210/801
7,117,685 B2 10/2006 Wetherbee
7,849,890 B2 * 12/2010 Jones ..... B63B 43/00 141/198

(56) References Cited

U.S. PATENT DOCUMENTS

| | | | | |
|---|---|---|---|---|
| 9,357,874 | B2 * | 6/2016 | Licare | A47J 31/467 |
| 10,016,055 | B2 * | 7/2018 | Burd | B64D 11/04 |
| 2002/0043069 | A1 * | 4/2002 | Niehaus | B67D 1/0869 62/3.64 |
| 2002/0162351 | A1 * | 11/2002 | Findley | C02F 1/686 62/434 |
| 2003/0115902 | A1 * | 6/2003 | Busick | B67D 3/0009 62/389 |
| 2004/0149422 | A1 * | 8/2004 | Jungwirth | F28D 1/0213 165/47 |
| 2004/0195262 | A1 * | 10/2004 | Hart | B67D 3/0029 222/1 |
| 2005/0269067 | A1 * | 12/2005 | Cowans | F28D 1/06 165/157 |
| 2006/0026987 | A1 * | 2/2006 | Wetherbee | B67D 3/0009 62/400 |
| 2008/0000358 | A1 * | 1/2008 | Goeckner | A47J 31/56 99/281 |
| 2008/0237260 | A1 * | 10/2008 | Wolek | B67D 3/0009 222/105 |
| 2009/0226588 | A1 | 9/2009 | Marx | |
| 2010/0079296 | A1 * | 4/2010 | Chen | H01L 21/67248 340/584 |
| 2010/0155415 | A1 * | 6/2010 | Ashrafzadeh | F25C 5/22 62/340 |
| 2012/0055584 | A1 * | 3/2012 | Chera | B67D 3/0009 141/242 |
| 2016/0007736 | A1 * | 1/2016 | Burd | A47B 31/06 62/285 |
| 2016/0073819 | A1 * | 3/2016 | Licare | A47J 31/4403 99/300 |

FOREIGN PATENT DOCUMENTS

| | | | |
|---|---|---|---|
| JP | S6067740 | A | 4/1985 |
| JP | 9-122016 | A | 5/1997 |
| JP | 2008-264486 | A | 11/2008 |
| WO | 1999/56065 | A1 | 11/1999 |
| WO | 2004/070294 | A1 | 8/2004 |
| WO | 2006/097436 | A1 | 9/2006 |
| WO | 2006/121514 | A1 | 11/2006 |

OTHER PUBLICATIONS

International Search Report and Written Opinion of related International Patent Application No. PCT/US2015/046291 dated Mar. 11, 2016.

Chinese Office Action for Application No. 201580055964.9, dated Dec. 17, 2018, 21 pages.

Japanese Office Action for Application No. 2017-529970, dated Sep. 24, 2019, 7 pages.

* cited by examiner

BEVERAGE CHILLER AND ASSOCIATED SYSTEMS AND METHODS

CROSS-REFERENCE TO RELATED APPLICATIONS

The present application is a 35 U.S.C. § 371 National Stage filing of International Application No. PCT/US2015/046291, filed on Aug. 21, 2015, which claims the benefit of U.S. Provisional Patent Application No. 62/040,651, which was filed on Aug. 22, 2014. The entire contents of each of the foregoing patent applications are incorporated herein by reference.

TECHNICAL FIELD

The present disclosure relates to beverage chillers and, in particular, to beverage chillers which allow creation and serving of a wide variety of freshly brewed and chilled beverages.

BACKGROUND

The chilled beverage market, such as iced coffee or iced tea, has evolved into a large and dynamic market where a consumer generally desires a large selection of choice and variety in their chilled beverage. For example, iced coffee beverages have become an integral part of the coffee experience. However, the methods for creating chilled beverages have not evolved beyond the simplistic techniques initially used in the industry.

Some conventional methods for creating a chilled beverage involve placing the hot beverage in a refrigerator or freezer after brewing. Other conventional methods for creating a chilled beverage involve allowing the hot beverage to sit for a period of time at room temperature until the temperature of the beverage has dropped. Some conventional methods involve adding ice directly into the beverage. Some conventional methods involve adding ice formed from the beverage, e.g., ice formed from freezing previously brewed coffee, to the hot beverage. Some conventional methods include cold brewing the beverage and serving the beverage over ice.

However, the conventional methods often used in the industry have several drawbacks. For example, the first two conventional methods discussed above require that the beverage remains in the refrigerator, freezer or at room temperature while the ambient temperature surrounding the beverage causes an overall reduction in the temperature of the beverage. Thus, the beverage is brewed in advance of the time of serving, yielding a stale product that has oxidized and developed off, bitter or sour flavor characteristics. These conventional methods also require storage space for each type or variety of beverage to be served.

With respect to the third conventional method, adding regular ice to the beverage can cause the beverage to become diluted, yielding a weak product if a normal strength beverage has been used. Therefore, in the case of a coffee beverage, additional coffee grounds are used in the brewing process to compensate for the dilution that occurs when regular ice is added, increasing costs for the provider of the beverage.

With respect to the fourth conventional method, adding ice formed from the beverage to the hot beverage requires the advanced preparation of the ice. Since the beverage ice is not fresh, the result is a stale product. The fourth conventional method may also require the creation of beverage ice for each type or variety of beverage to be served in order to avoid inadvertently mixing beverage types or varieties. Adequate storage space, additional labor for production, and additional labor for sorting of the multiple beverage ice types and varieties can therefore be necessitated.

With respect to the fifth conventional method, cold brewing involves soaking, in this example, coffee grinds in cold water for an extended period of time, e.g., approximately ten to twelve hours. In addition to preparing an individual bath for each type or variety of beverage to be served, a cold brewed beverage cannot be quickly replenished if a low inventory occurs. Advanced preparation and coordination is therefore required to have a steady supply of cold brewed coffee on hand.

Thus, the conventional methods used in the preparation of a chilled beverage from a hot beverage result in a limited number of chilled beverage types or varieties, none of which can be served freshly brewed.

SUMMARY

Exemplary embodiments of the present disclosure overcome the disadvantages of conventional chilled beverage systems by providing a beverage chiller which allows creation and serving of a wide variety of freshly brewed hot and subsequently chilled beverages for each individual consumer. The type or variety of a chilled beverage can thereby be selected by a consumer and the chilled beverage can be freshly brewed in an efficient and timely manner. In particular, the chilled beverage can be freshly brewed and presented to the consumer as a chilled beverage within a matter of seconds or minutes without being diluted. The chilled beverage is therefore fresh, cold and customized based on the beverage type or variety, while requiring minimal labor to produce.

In accordance with embodiments of the present disclosure, exemplary beverage chillers for chilling a hot beverage are provided. The beverage chillers include a beverage collection section, a heat exchanger section, and a dispensing section fluidically connected relative to each other. The beverage collection section can be configured to receive a beverage in a hot state. The heat exchanger section can be configured to chill or cool the beverage from the hot state to a predetermined chilled temperature, e.g., a temperature below the hot state temperature. The dispensing section dispenses the beverage at or near the predetermined chilled temperature.

The beverage chillers can include a removable lid for addition of a cooling medium into the heat exchanger section. The beverage collection section includes an opening for introduction of the beverage in the hot state. In some embodiments, the beverage collection section includes a pre-chilling container configured to house the beverage in the hot state prior to introduction of the beverage into the heat exchanger section.

The heat exchanger section includes an outer housing surrounding a chamber. The heat exchanger section further includes a heat exchanger having a structure to transfer heat from the hot beverage. The heat exchanger can include an ice bath in contact with tubing fluidically coupled to the beverage collection section. The heat exchanger can include a double pipe heat exchanger with a refrigerant circulating through an outer tube that surrounds an inner tube fluidically coupled to the beverage collection section. The heat exchanger can include a thermoelectric heat exchanger, for example, a Peltier device with the hot beverage flowing on or around the cool side of the Peltier device. In some embodiments, the heat exchanger includes tubing, e.g., coiled tubing, for passage of the beverage therethrough. The tubing includes a first end, e.g., an inlet, through which the beverage is introduced in the hot state. The tubing includes a second end, e.g., an outlet, from which the beverage is dispensed at the predetermined chilled temperature to the dispensing section.

In some embodiments, the heat exchanger section includes a tube for draining overflow of a cooling medium from the heat exchanger section. The dispensing section includes a platform configured to receive thereon a container, e.g., a cup, a pitcher, a carafe, and the like, into which the beverage can be dispensed at or near the predetermined chilled temperature. In some embodiments, the dispensing section includes a base including a drain fitting for draining at least one of a cooling medium from the heat exchanger section or fluid on a platform of the dispensing section, e.g., fluid spilled on the platform.

In accordance with embodiments of the present disclosure, exemplary methods of chilling a hot beverage are provided. The methods include providing a beverage chiller as described herein. The methods include introducing the beverage in the hot state into the beverage collection section. The methods include passing the beverage in the hot state through the heat exchanger section. The beverage can be chilled from the hot state to the predetermined chilled temperature during passage through the heat exchanger section. The methods include dispensing the beverage at or near the predetermined chilled temperature at the dispensing section.

In some embodiments, the methods include draining at least a portion of a cooling medium from the heat exchanger section. In some embodiments, passing the beverage in the hot state through the heat exchanger section includes passing the beverage in the hot state through coiled tubing of a heat exchanger.

In accordance with embodiments of the present disclosure, exemplary beverage chiller systems for chilling a hot beverage are provided. The systems include a brewer for brewing a hot beverage. The systems include a heat exchanger section and a dispensing section. The brewer can dispense the beverage in a hot state into the heat exchanger section. The heat exchanger section can chill the beverage from the hot state to a predetermined chilled temperature. The dispensing section can dispense the beverage at or near the predetermined chilled temperature. The brewer includes an inlet for receiving a fluid and a brewing medium. In some embodiments, the heat exchanger section is disposed within the brewer.

Any combination and/or permutation of embodiments is envisioned. Other objects and features will become apparent from the following detailed description considered in conjunction with the accompanying drawings. It is to be understood, however, that the drawings are designed as an illustration only and not as a definition of the limits of the present disclosure.

BRIEF DESCRIPTION OF THE DRAWINGS

To assist those of skill in the art in making and using the disclosed beverage chillers and associated systems and methods, reference is made to the accompanying figures, wherein.

DETAILED DESCRIPTION

Exemplary embodiments of the present disclosure are directed to beverage chillers which allow creation and serving of a wide variety of freshly brewed hot and subsequently chilled beverages in real time on demand fashion. The type or variety of a chilled beverage can be selected by a consumer and the chilled beverage can be freshly brewed in an efficient and timely manner. In particular, the chilled beverage can be freshly brewed and presented to the consumer in a chilled state within a matter of seconds or minutes without being diluted. The chilled beverage is therefore transformed from a hot beverage to a chilled beverage in real time on demand fashion and is fresh, cold and customized based on beverage type or variety, while requiring minimal labor to produce.

Figure 1:
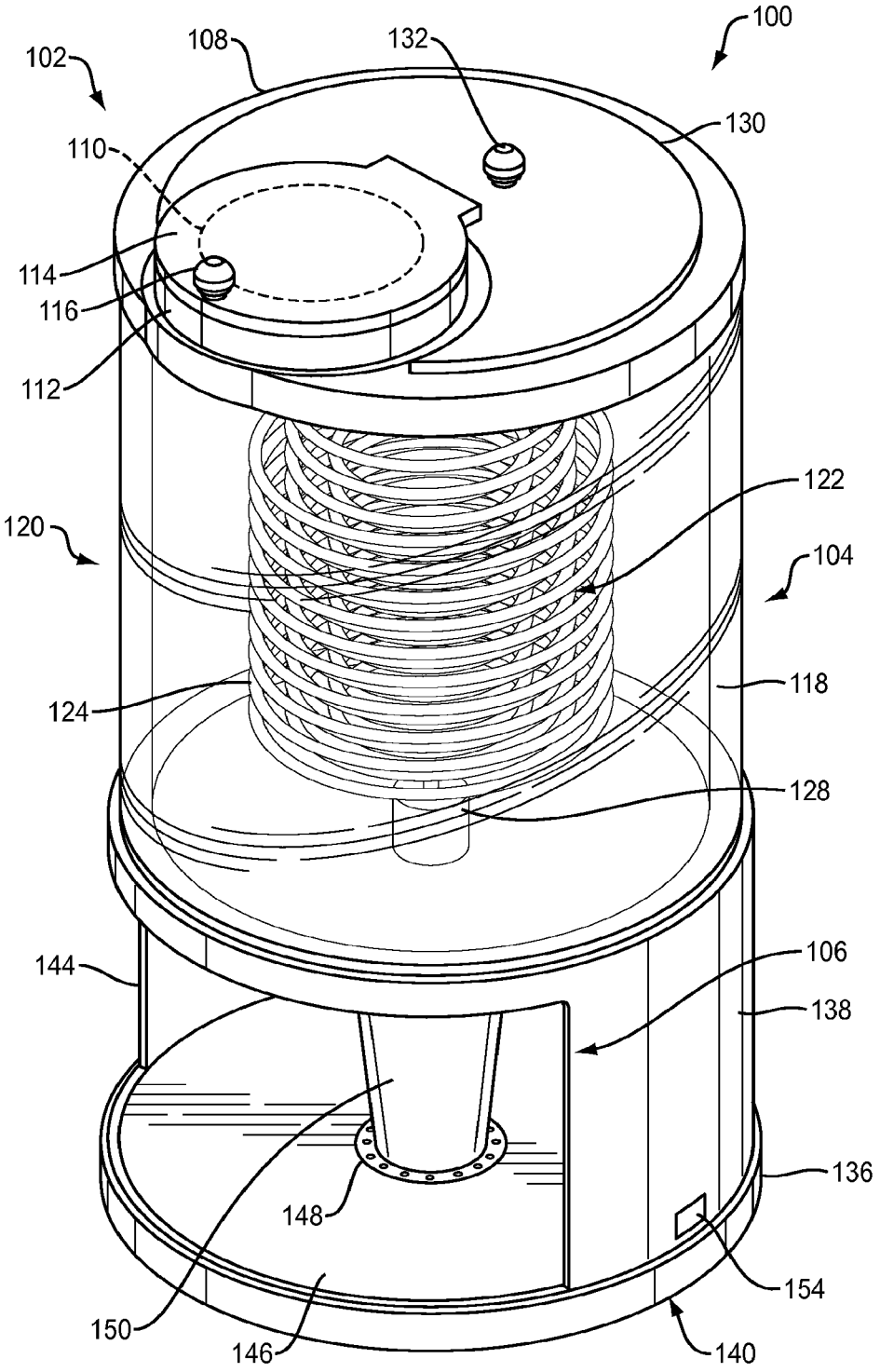
FIG. 1 is a perspective view of an exemplary beverage chiller according to the present disclosure.
Figure 2:
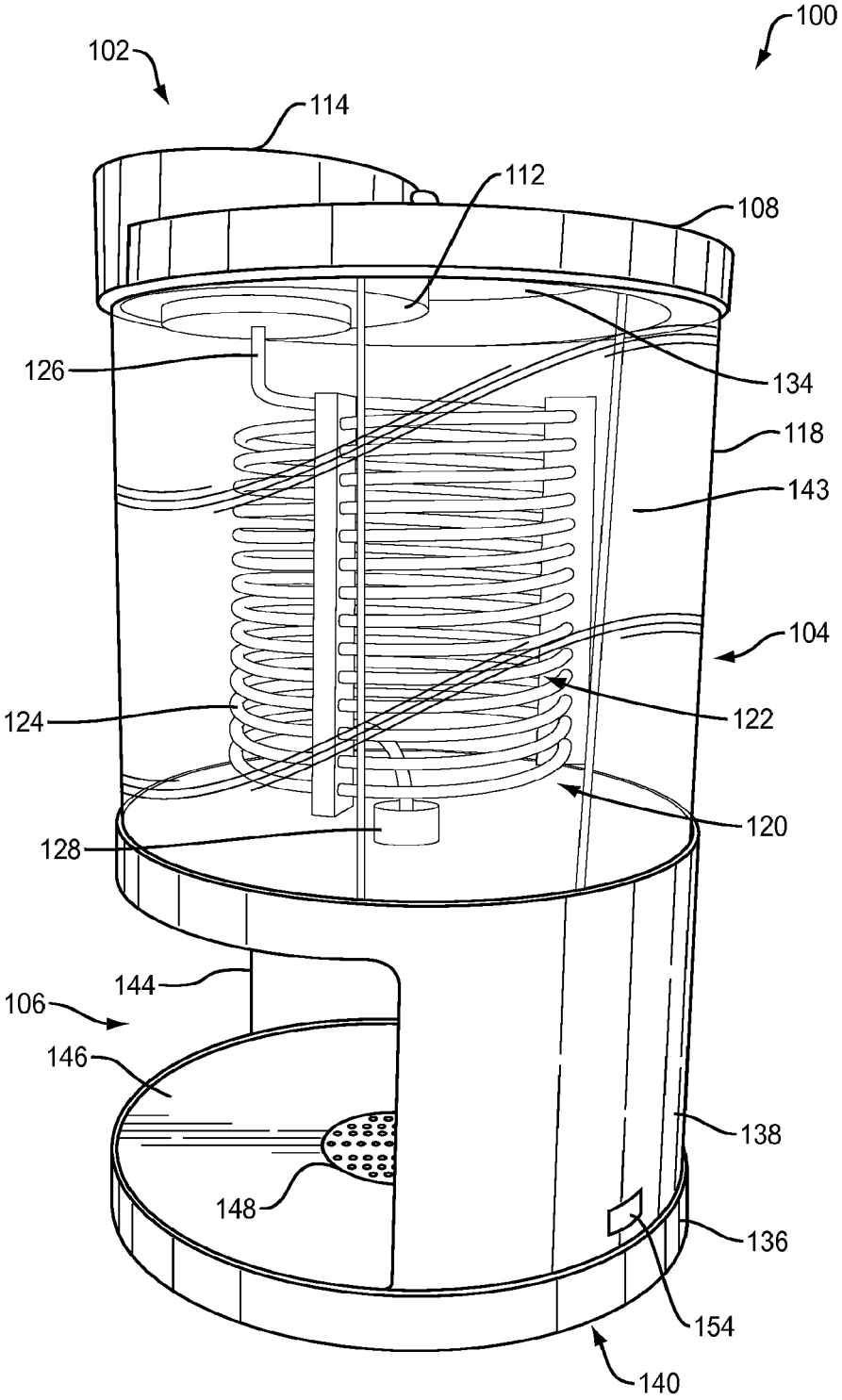
FIG. 2 is a side view of an exemplary beverage chiller of FIG. 1.
Figure 3:
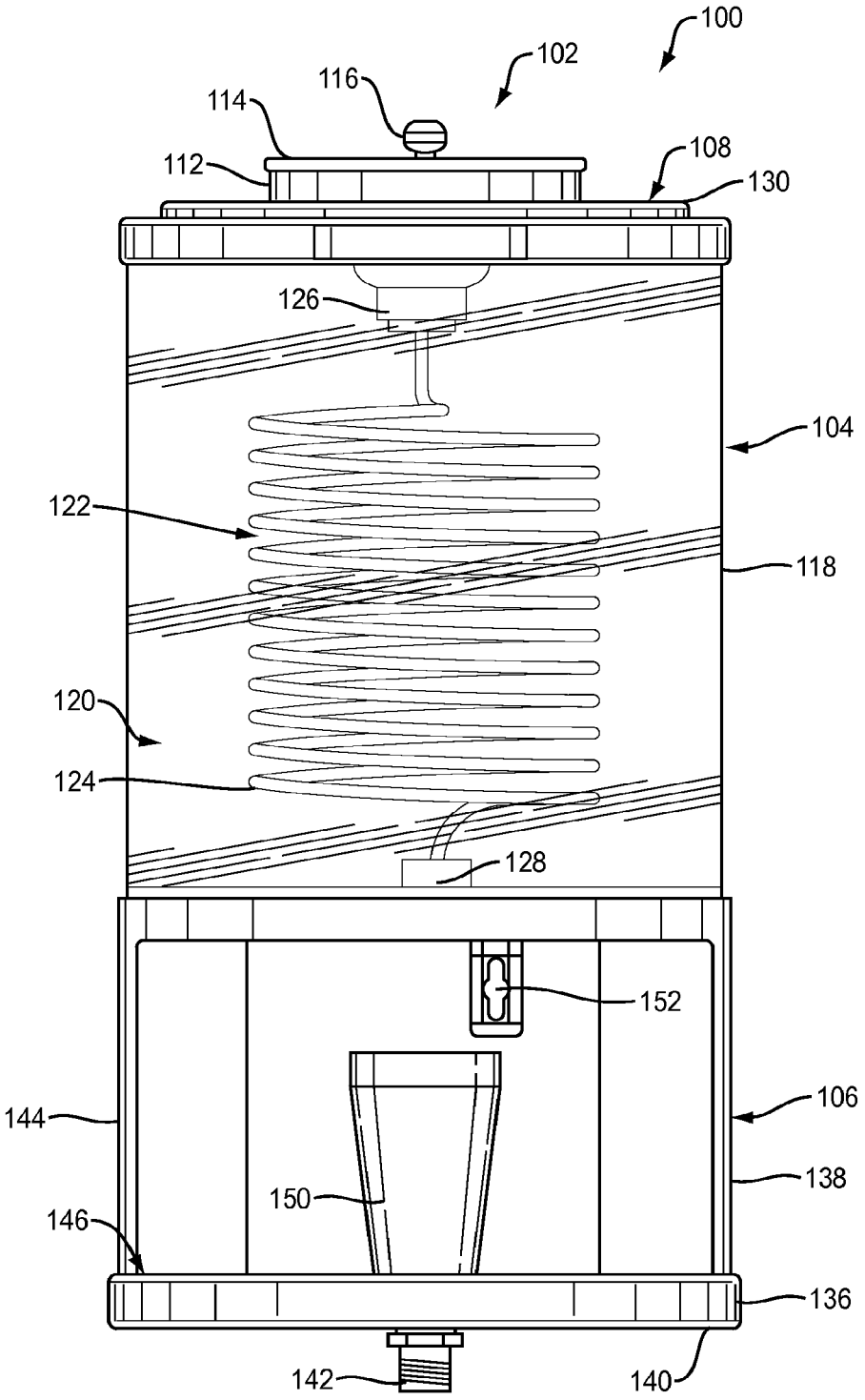
FIG. 3 is a front view of an exemplary beverage chiller of FIG. 1.
Figure 4:
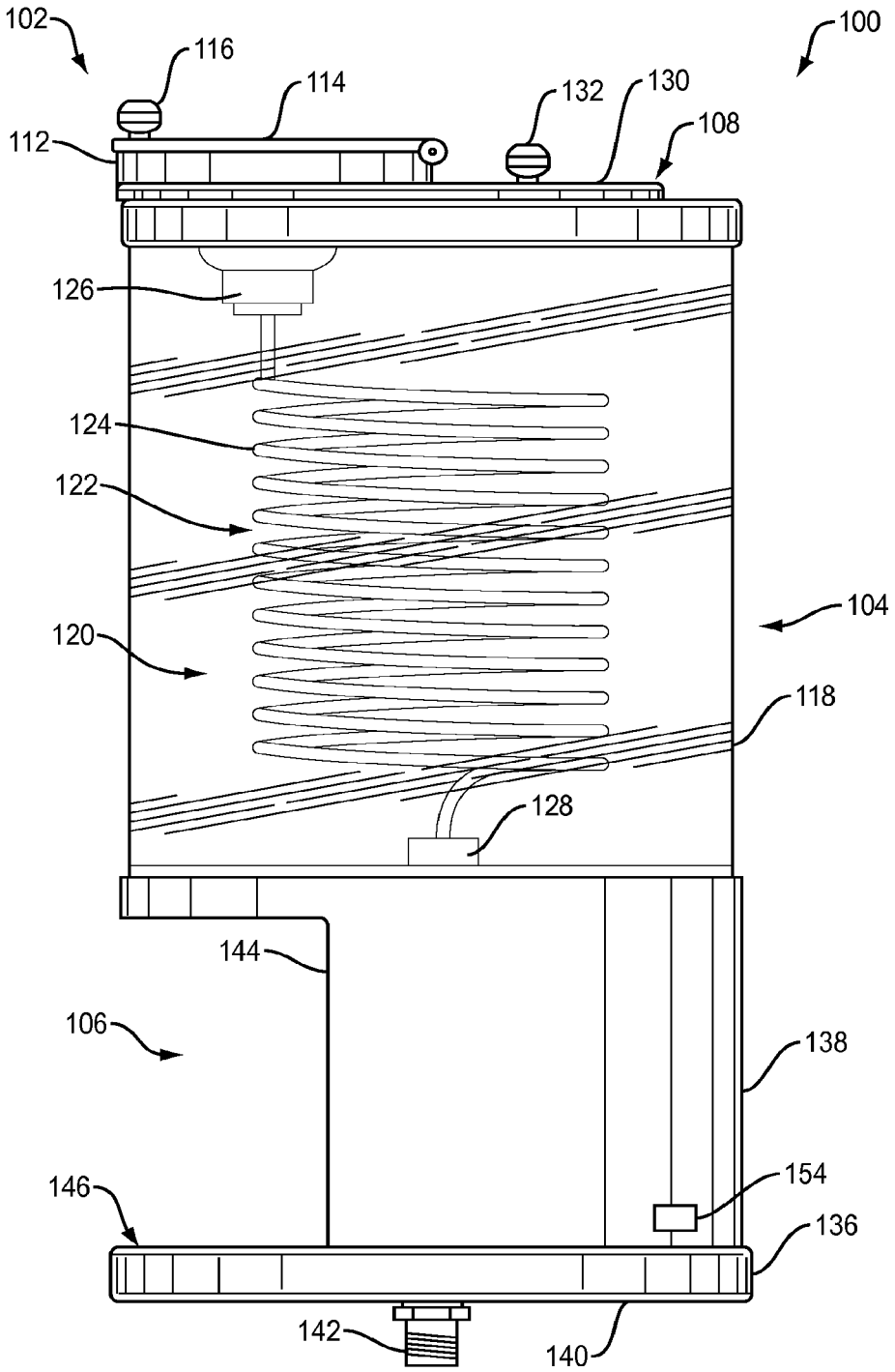
FIG. 4 is a side view of an exemplary beverage chiller of FIG. 1.
Figure 5:
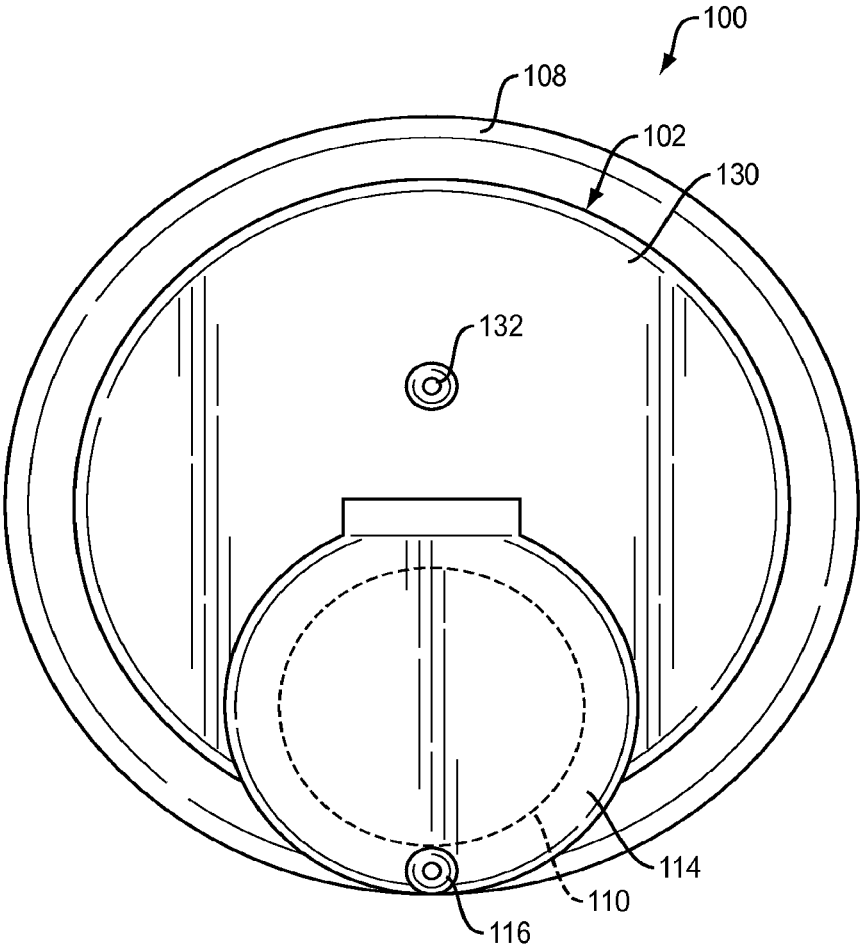
FIG. 5 is a top view of an exemplary beverage chiller of FIG. 1.

FIGS. 1-5 show views of an exemplary beverage chiller 100 according to the present disclosure. In particular, FIGS. 1 and 2 show perspective views of the beverage chiller 100. FIG. 3 shows a front view of the beverage chiller 100. FIG. 4 shows a side view of the beverage chiller 100. FIG. 5 shows a top view of the beverage chiller 100.

The shape of the beverage chiller shown is merely exemplary. A beverage chiller as taught herein can have a number of different shapes, for example, square, rectangle, triangle, round, oval, tapered and so on.

As used herein, the term beverage includes a coffee based beverage brewed from coffee and a tea based beverage from tea.

The beverage chiller 100 includes a beverage collection section 102, a heat exchanger section 104 and a dispensing section 106. In some embodiments, the beverage chiller 100 can define a substantially cylindrical configuration. The beverage collection section 102 can be located at or near a top surface 108 of the beverage chiller 100. In some embodiments, the top surface 108 can be in the form of a removable lid. The beverage collection section 102 includes an opening 110, e.g., a circular opening, through which a hot brewed beverage can be introduced into the beverage chiller 100 for cooling. In some embodiments, the opening 110 can be fluidically coupled to an output of a brewer. In some embodiments, the opening 110 can be spaced apart from an output of a brewer to allow for other means to introduce a hot beverage into the beverage chiller 100. For example, the beverage can initially be brewed and poured into the beverage chiller 100 through the opening 110 in a hot state.

In some embodiments, when the brewed beverage passes through the opening 110, the heat exchanger section 104 can automatically begin cooling the beverage. In some embodiments, when the brewed beverage passes through the opening 110, the beverage can initially be stored in a pre-chilling container 112 until a user starts the heat exchange process by, for example, depressing a "start" button or toggling a "start" switch or any other suitable manner of starting the heat exchange process. In some embodiments, the heat exchange process can be triggered by a computerized or electronic start of the initial brew process. Depressing the "start" button can release the beverage from the pre-chilling container 112 into the heat exchanger section 104 to commence chilling of the beverage. The pre-chilling container 112 can define a capacity sufficient to house a variety of beverage sizes, e.g., different cup sizes, multiple servings, and the like. In particular, the pre-chilling container 112 can define a capacity sufficiently large to hold the entire amount of the beverage to be cooled or chilled.

The beverage collection section 102 can include a lid 114 movably (e.g., hingedly) attached to the rim of the opening 110. The position of the lid 114 can be regulated to open or cover the opening 110 to permit passing of the hot beverage into the beverage chiller 100. In some embodiments, the lid 114 can include a grip 116, e.g., a protrusion or knob, extending from the lid 114 to provide a user with a feature which can be grasped and pulled upon to regulate the position of the lid 114 relative to the opening 110.

The heat exchanger section 104 transfers the heat of the beverage poured into beverage collection section 102 into another medium to cool the beverage. As will be discussed in greater detail below, the heat exchanger section 104 can accomplish the desired heat transfer in a variety of ways. The heat exchanger section 104 generally includes an outer housing 118 connected to the top surface 108, e.g., a removable lid, of the beverage chiller 100. The outer housing 118 defines a chamber 120 therein for housing a heat exchanger 122. The heat exchanger 122 includes a structure to transfer heat from the hot beverage. In some embodiments, the heat exchanger 122 can include an ice bath in contact with tubing fluidically coupled to the beverage collection section 102. In some embodiments, the heat exchanger 122 can include a double pipe heat exchanger with a refrigerant circulating through an outer tube that surrounds an inner tube fluidically coupled to the beverage collection section 102. In some embodiments, the heat exchanger 122 can include a thermoelectric heat exchanger, for example, a Peltier device with the hot beverage flowing on or around the cool side of the Peltier device.

In some embodiments, the heat exchanger 122 includes tubing 124, e.g., coiled tubing, for passage of the beverage during the cooling process. The length, diameter, or both, of the tubing 124 can be selected such that a hot beverage passing through the tubing 124 is sufficiently cooled or chilled upon exit from the heat exchanger 122. In some embodiments, multiple tubes (e.g., two or more tubes 124) can be used to increase the amount of beverage held inside the heat exchanger 122 at one time. In some embodiments, the outer housing 118 can be translucent to permit viewing the contents of the chamber 120. In some embodiments, the outer housing 118 can be opaque.

The hot beverage can enter the heat exchanger 122 at a first end 126, e.g., a starting point, fluidically connected to the beverage collection section 102. As the beverage flows through the heat exchanger 122, heat can be transferred from the beverage and into an alternative medium. When the beverage reaches the second end 128, e.g., an end point, of the heat exchanger 122, the beverage is cooled or chilled to the desired temperature. In some embodiments, the temperature to which the beverage is cooled or chilled by the heat exchanger 122 can be regulated by a user via a graphical user interface (not shown). In some embodiments, the temperature to which the beverage is cooled or chilled by the heat exchanger 122 can be regulated by a computer database. In some embodiments, the top surface 108 of the beverage chiller 100 can include a cover 130 which can be removed from the top surface 108 for, e.g., positioning of a cooling element into the chamber 120, maintenance, cleaning, and the like. In some embodiments, the cover 130 can include a grip 132, e.g., a protrusion or knob, extending from the cover 130 to provide a user with a feature which can be grasped and pulled upon to remove the cover 130 relative to the top surface 108 of the beverage chiller 100. Removing the cover 130 from the top surface 108 can expose an opening 134 leading to the chamber 120 (see, e.g., FIG. 2). In some embodiments, the opening 134 can be substantially crescent-shaped.

The second end 128 of the heat exchanger 122 can be fluidically connected to the dispensing section 106. In some embodiments, the tubing 124, the second end 128 of the heat exchanger 122, or both, can include a valve or regulation mechanism which prevents the chilled beverage from being dispensed from the beverage chiller 100 until an appropriate button or level has been depressed by a user. In some embodiments, the chilled beverage can automatically be dispensed from the beverage chiller 100 when the target temperature set by a user in a graphical user interface or by a predetermined value in a computer database is reached. In some embodiments, the chilled beverage can automatically be dispensed from the beverage chiller 100 without actuation of a button or lever.

The dispensing section 106 includes a base 136 upon which the beverage collection section 102, the heat exchanger section 104 and a dispenser housing 138 are positioned. In some embodiments, the base 136 can include one or more textured features, e.g., protrusions, rubber dimples, and the like, on a bottom surface 140 to securely maintain the position of the beverage chiller 100 on a surface, e.g., a countertop. In some embodiments, the dispensing section 106 includes a drain fitting 142 extending from the bottom surface 140 (see, e.g., FIGS. 3 and 4). The drain fitting 142 can be fluidically connected to the chamber 120 of the heat exchanger section 104 and can permit draining of at least a portion of the cooling medium.

In some embodiments, the chamber 120 can include a tube 143, e.g., a vertical tube, therein such that any overflow of the cooling medium, e.g., melted ice, can drain out of the beverage chiller 100 into plumbed drain below (see, e.g., FIG. 2). The tube 143 allows the addition of cooling medium to the chamber 120 without flooding the heat exchanger section 104. The drain fitting 142 can be dimensioned to fit within a complementary opening in a countertop for draining of at least a portion of the cooling medium. In some embodiments, the cooling medium can be drained automatically upon detection by a sensor (not shown) within the chamber 120 of a cooling medium which has been overused. In some embodiments, a portion of the cooling medium can be drained automatically upon reaching a predetermined height within the chamber 120. In some embodiments, the cooling medium can be drained manually by a user by actuation of a button or lever.

In some embodiments, the dispenser housing 138 can define a substantially cylindrical configuration. In some embodiments, the dispenser housing 138 includes a cut-out 144 positioned at the front of the beverage chiller 100. The cut-out 144 can be configured and dimensioned to expose a platform 146 on a surface opposing the bottom surface 140 of the base 136. The platform 146 can include a centrally located drain 148 dimensioned to receive a container 150, e.g., a cup, thereon. The dispensing section 106 includes a spout 152 fluidically connected to the second end 128 of the heat exchanger 122 such that the chilled beverage can be dispensed from the beverage chiller 100 into the container 150. The spout 152 can therefore extend downwardly away from the heat exchanger section 104 and in the direction of the platform 146.

If a portion of the chilled beverage spills during dispensing of the chilled beverage into the container 150 or movement of the container 150 out of the dispenser housing 138 onto the platform 146, the chilled beverage can pass through the openings in the drain 148 and into the drain fitting 142 to prevent the accumulation of liquid on the platform 146. In some embodiments, in addition to or rather than a drain 148, the beverage chiller 100 can include a collection pan (not shown) positioned beneath the platform 146 for collection of spilled liquid. Thus, it should be understood that a hot beverage can be passed through the beverage chiller 100 and dispensed into the container 150 for the consumer in a cooled or chilled manner in a timely manner, while maintaining the beverage fresh.

In some embodiments, the beverage chiller 100 can include one or more electronic connections 154 for electronically connecting the beverage chiller 100 to, for example, a computer, a network, or both. Although shown as located on the dispenser housing 138, it should be understood that the electronic connection 154 can be positioned on other areas of the beverage chiller 100. The electronic connection 154 can be configured to receive, e.g., a Category 5 cable, a serial connection, a Universal Serial Bus (USB) cable, and the like. In some embodiments, the beverage chiller 100 can be electronically connected to an electronic brewer, e.g., a super-automated espresso machine, which can control the operation of the beverage chiller 100.

Tables 1-6 below provide experimental results regarding chilling of beverages in a timely manner. In each of Tables 1-6, "Temperature In" represents the temperature of the hot beverage in degrees Fahrenheit entering the heat exchanger, "Temperature Out" represents the temperature of the chilled beverage in degrees Fahrenheit after passing through the heat exchanger, "Temperature Reduction" represents the difference in temperature in degrees Fahrenheit between the "Temperature In" and the "Temperature Out", "Time" represents the time in seconds for cooling the beverage, and "Volume" represents the mass in grams of the beverage being cooled.

With respect to Table 1, beverages were passed through a single coil of tubing (e.g., the heat exchanger) having a coil length of approximately 178 inches and an overall height of approximately 11.7 inches. The coil was installed in an ice chamber, e.g., an ice bath, and five beverages were passed through the coil within three minutes. Although two time entries were unavailable, from the remaining data presented in Table 1, it can be seen that a significant reduction in the temperature of the beverages was achieved within a matter of seconds.

TABLE 1

| Temperature In (° F.) | Temperature Out (° F.) | Temperature Reduction (° F.) | Time (sec) | Volume (mass in g) |
|---|---|---|---|---|
| 174 | 48 | 126 | N/A | 133 |
| 170 | 59 | 111 | N/A | 133 |
| 169 | 62 | 107 | 20.1 | 133 |

TABLE 1-continued

| Temperature In (° F.) | Temperature Out (° F.) | Temperature Reduction (° F.) | Time (sec) | Volume (mass in g) |
|---|---|---|---|---|
| 165 | 64 | 101 | 19.4 | 133 |
| 165 | 65 | 100 | 19.3 | 133 |

With respect to Table 2, beverages were passed through a single coil of tubing (e.g., the heat exchanger) having a coil length of approximately 178 inches and an overall height of approximately 11.7 inches. The coil was installed in an ice chamber, e.g., an ice bath, and two beverages were passed through the coil. The coil was tilted slightly in the ice chamber due to a fill funnel inside the ice chamber. Therefore, the coil incline angle was not consistent along the length of the coil and the small volume of the beverage may not have been able to pass through the coil at a consistent velocity. However, based on the data presented in Table 2, a significant reduction in the temperature of the beverages was still achieved within a matter of seconds.

TABLE 2

| Temperature In (° F.) | Temperature Out (° F.) | Temperature Reduction (° F.) | Time (sec) | Volume (mass in g) |
|---|---|---|---|---|
| 184 | 45 | 139 | 36.5 | 68 |
| 182 | 49 | 133 | 34.2 | 68 |

With respect to Table 3, beverages were passed through a single coil of tubing (e.g., the heat exchanger) having a coil length of approximately 178 inches and an overall height of approximately 13.7 inches. The coil was installed in an ice chamber, e.g., an ice bath, and three beverages were passed through the coil. As can be seen from the data presented in Table 3, a significant reduction in the temperature of the beverages was achieved within a matter of seconds.

TABLE 3

| Temperature In (° F.) | Temperature Out (° F.) | Temperature Reduction (° F.) | Time (sec) | Volume (mass in g) |
|---|---|---|---|---|
| 186 | 56 | 130 | 24.9 | 68 |
| 182 | 53 | 129 | 25.5 | 68 |
| 178 | 54 | 124 | 25.3 | 68 |

With respect to Table 4, beverages were passed through a single coil of tubing (e.g., the heat exchanger) having a coil length of approximately 178 inches and an overall height of approximately 13.7 inches. The coil was installed in an ice chamber, e.g., an ice bath, and five beverages were passed through the coil within two minutes and twenty seconds. Although one time entry was unavailable, from the remaining data presented in Table 4, it can be seen that a significant reduction in the temperature of the beverages was achieved within a matter of seconds.

TABLE 4

| Temperature In (° F.) | Temperature Out (° F.) | Temperature Reduction (° F.) | Time (sec) | Volume (mass in g) |
|---|---|---|---|---|
| 178 | 68 | 110 | N/A | 133 |
| 179 | 76 | 103 | 15.8 | 133 |
| 177 | 77 | 100 | 15.6 | 133 |
| 179 | 80 | 99 | 15.9 | 133 |
| 179 | 80 | 99 | 15.8 | 133 |

With respect to Table 5, beverages were passed through a single coil of tubing (e.g., the heat exchanger) having a coil length of approximately 178 inches and an overall height of approximately 13.7 inches. The coil was installed in an ice chamber, e.g., an ice bath, and three beverages were passed through the coil at thirty second intervals. As can be seen from the data presented in Table 5, a significant reduction in the temperature of the beverages was achieved within a matter of seconds.

TABLE 5

| Temperature In (° F.) | Temperature Out (° F.) | Temperature Reduction (° F.) | Time (sec) | Volume (mass in g) |
|---|---|---|---|---|
| 181 | 71 | 110 | 16.3 | 133 |
| 179 | 74 | 105 | 16.0 | 133 |
| 178 | 77 | 101 | 16.1 | 133 |

With respect to Table 6, beverages were passed through a single coil of tubing (e.g., the heat exchanger) having a coil length of approximately 178 inches and an overall height of approximately 13.7 inches. The coil was installed in an ice chamber, e.g., an ice bath, and three beverages were passed through the coil at one minute intervals. Although two time entries were unavailable, as can be seen from the remaining data presented in Table 6, a significant reduction in the temperature of the beverages was achieved within a matter of seconds.

TABLE 6

| Temperature In (° F.) | Temperature Out (° F.) | Temperature Reduction (° F.) | Time (sec) | Volume (mass in g) |
|---|---|---|---|---|
| 179 | 71 | 108 | 16.4 | 133 |
| 176 | 76 | 100 | N/A | 133 |
| 173 | 72 | 101 | N/A | 133 |

Based on the data presented in Tables 1-6, passage of hot, freshly brewed beverages through the exemplary beverage chiller resulted in a significant reduction in the temperature of the beverages within a matter of seconds. Thus, the beverage chiller provided freshly brewed and chilled beverages in a timely manner.

Figure 6:
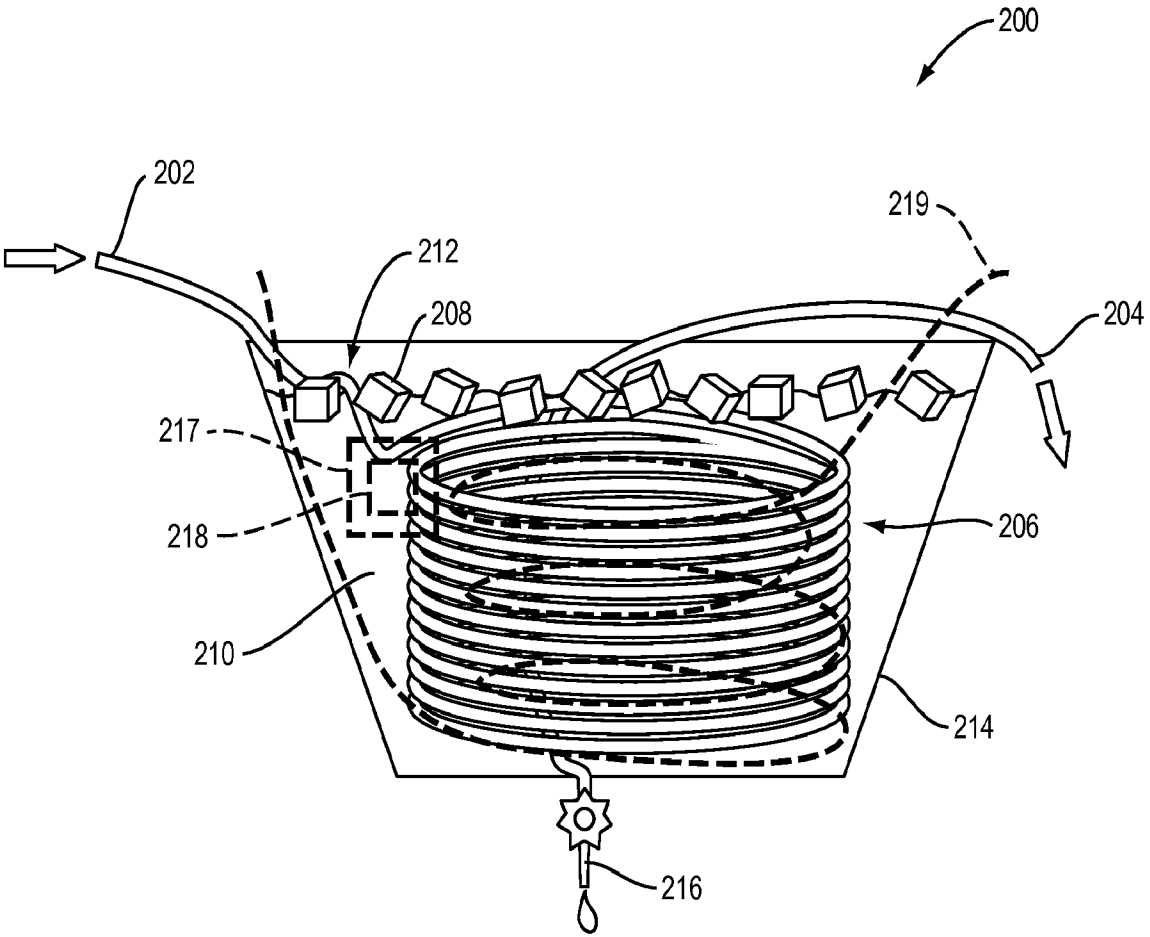
FIG. 6 is a diagrammatic side view of a first embodiment of a heat exchanger of an exemplary beverage chiller of FIG. 1.

With reference to FIG. 6, one embodiment of an exemplary heat exchanger 200, e.g., an ice bath, an ice or chiller water/brine bath, and the like, for implementation within the heat exchanger section 104 of the beverage chiller 100 is provided. As will be discussed in greater detail below, the heat exchanger 200 includes a structure to transfer heat from the hot beverage. In the embodiment of FIG. 6, the heat exchanger 122 can include an ice bath in contact with tubing fluidically coupled to the beverage collection section 102.

The heat exchanger 200 includes coiled tubing 202 through which the beverage flows. In particular, the beverage can enter the tubing 202 at a first end 204, e.g., an inlet, in a hot state and, upon passage through the tubing 202, can be dispensed from the tubing at a second end 206, e.g., an outlet, in a cold or chilled state. The tubing 202 can be fabricated from a thermally conductive material, e.g., stainless steel. The tubing 202 can be positioned or immersed in an ice bath 206 consisting of ice 208 and water 210 or a solution of water and brine. For example, the tubing 202 can pass through a chamber 212 formed by the housing 214 of the heat exchanger 200 which contains the ice bath 206.

As the hot beverage passes through the tubing 202, heat can be transferred from the beverage, through the walls of the tubing 202, and further into the ice bath 206. By the time the beverage travels the length of the tubing 202 from the first end 202 to the second end 204, the beverage can be cooled to the desired temperature. In some embodiments, new or additional ice 208 can be periodically added to the ice bath 206 as the ice 208 melts due to the introduction of heat from the beverage. The temperature of the ice bath 206 can thereby be maintained. For example, with respect to the beverage chiller 100 of FIGS. 1-5, the ice bath 206 can be maintained within the chamber 120 and additional ice 208 can be added to the ice bath 206 through the opening 134. In some embodiments, the chamber 214 can include a drain 216 to allow plumbing of the chamber 214. Excess water, brine, or both, can thereby be removed from the chamber 214.

In some embodiments, the heat exchanger 200 can optionally include visual monitoring, electronic monitoring, or both, of the temperature of the ice bath 206 to ensure that the temperature of the ice bath 206 is maintained below a certain point. For example, the heat exchanger 200 can include a monitoring device 217, e.g., a thermometer, a thermocouple, and the like, positioned in or on the ice bath 206 which monitors the temperature of the ice bath 206. In some embodiments, the monitoring device 217 can include an alert section 218 which can output a visual alert, auditory alert, or both, when the temperature of the ice bath 206 has reached a certain point. Thus, when the temperature of the ice bath 206 has reached a preset or predetermined point, an alert can be output by the monitoring device 217 to alert a user that additional ice 208 should be added to the ice bath 206.

In some embodiments, the ice bath 206 can optionally include a refrigerant coil 219 passing therethrough. The refrigerant coil 219 can include refrigerant therein for cooling and maintaining the temperature of the ice bath 206. For example, a compressor for the refrigerant can cycle on and off as the temperature of the ice bath 206 dictates. In some embodiments, the compressor can be controlled by the monitoring device 217. By cooling the ice bath 206 with the refrigerant coil 219, the ice bath 206 can be maintained at the desired temperature for chilling beverages without the addition of extra ice 208.

Figure 7:
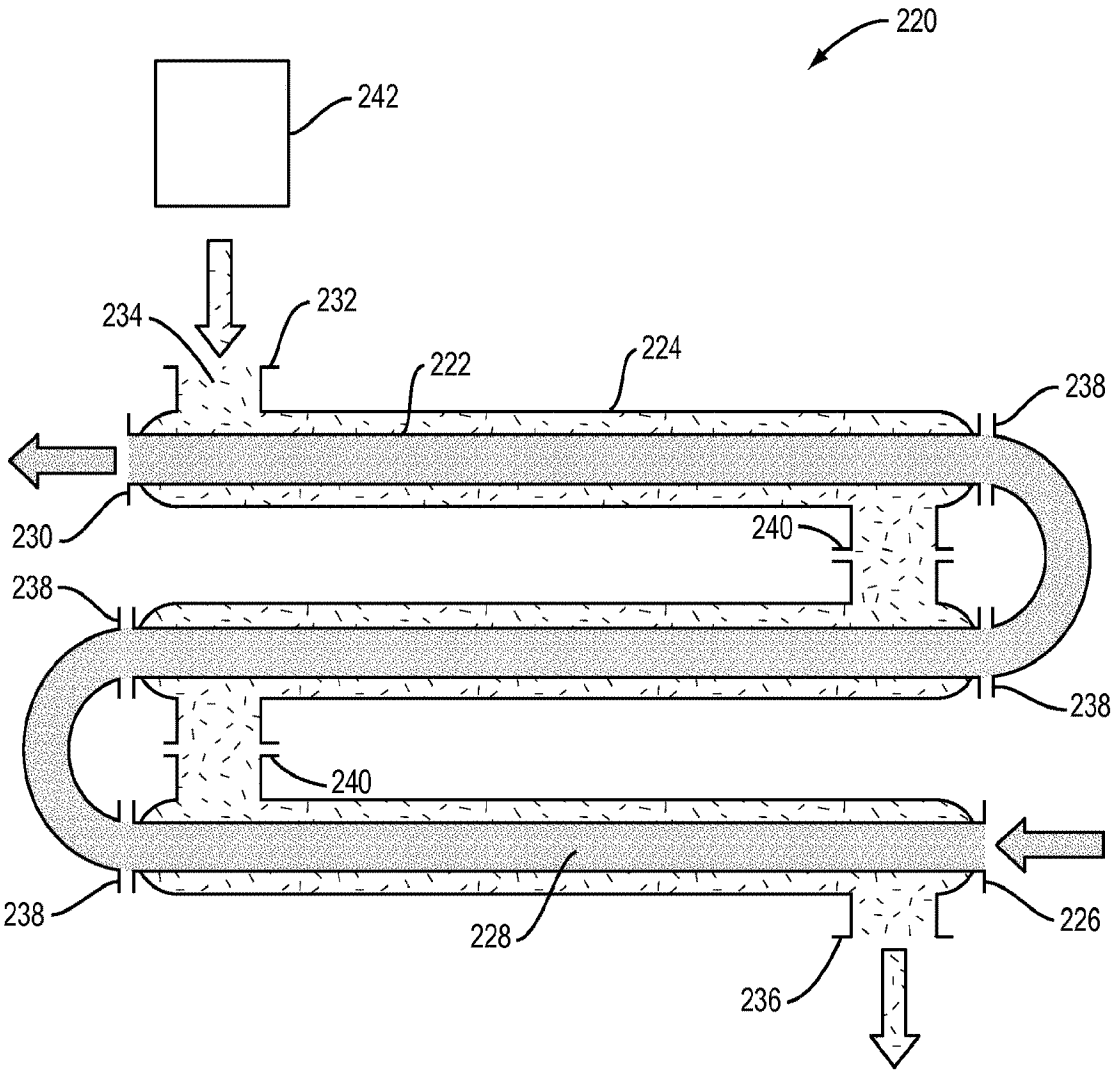
FIG. 7 is a diagrammatic side view of a second embodiment of a heat exchanger of an exemplary beverage chiller of FIG. 1.

With reference to FIG. 7, another embodiment of an exemplary heat exchanger 220, e.g., a condenser, for implementation within the heat exchanger section 104 of the beverage chiller 100 is provided. As will be discussed in greater detail below, the heat exchanger 220 includes a structure to transfer heat from the hot beverage. In the embodiment of FIG. 7, the heat exchanger 220 can include a double pipe heat exchanger with a refrigerant circulating through an outer tube that surrounds an inner tube fluidically coupled to the beverage collection section 102.

The heat exchanger 220 can define a double-pipe heat exchanger that includes an inner tube 222 and an outer tube 224. In at least a portion of the heat exchanger 220, the outer tube 224 can be concentrically positioned around the inner tube 222. The inner tube 222 includes a first end 226, e.g., an inlet, through which the beverage 228 can enter the heat exchanger 220 in a hot state. The inner tube 222 further includes a second end 230, e.g., an outlet, at an opposing end of the inner tube 222 relative to the first end 226 from which the beverage 228 can be dispensed in a cooled or chilled state.

The outer tube 224 includes a first end 232, e.g., an inlet, through which a refrigerant 234, such as glycol, can be pumped. The outer tube 224 further includes a second end 236, e.g., an outlet, at an opposing end of the outer tube 224 relative to the first end 232 from which the refrigerant 234 can be dispensed. In some embodiments, the inner tube 222, the outer tube 224, or both, can include one or more flanges 238, 240, respectively, for forming bends or coils in the inner tube 222 and outer tube 224. Although depicted in a serpentine configuration, other configurations are possible as well, for example, circular, oval and the like.

A condenser unit 242 can pump the refrigerant 234 through the outer tube 224 such that the refrigerant 234 circulates around the inner tube 222. The beverage 228 can flow through the inner tube 222 and transfers the heat from the beverage 228 into the outer tube 224 and the refrigerant 234. As the refrigerant 234 is ejected from the outer tube 224 at the second end 236, the refrigerant 234 can be cooled and recirculated to the first end 232 for cooling of the beverage 228. The beverage 228 can thereby be cooled as the beverage 228 passes through the inner tube 222. In some embodiments, the refrigerant 234 can be electronically monitored by a refrigerating unit to maintain the temperature of the refrigerant 234 below a certain amount, thereby ensuring that the refrigerant 234 appropriately chills the beverage 228. Although the refrigerant 234 may need to be replaced or added to maintain the desired amount of refrigerant 234 in the heat exchanger 220 after numerous uses, the heat exchanger 220 does not require the addition or replacement of ice to maintain the desired cooling of the beverage 228. In addition, the heat exchanger 220 can be fabricated to define a smaller amount of space as compared to the heat exchanger 200, since the heat exchanger 220 does not include an ice chamber surrounding the heat exchanger 200.

Figure 8:
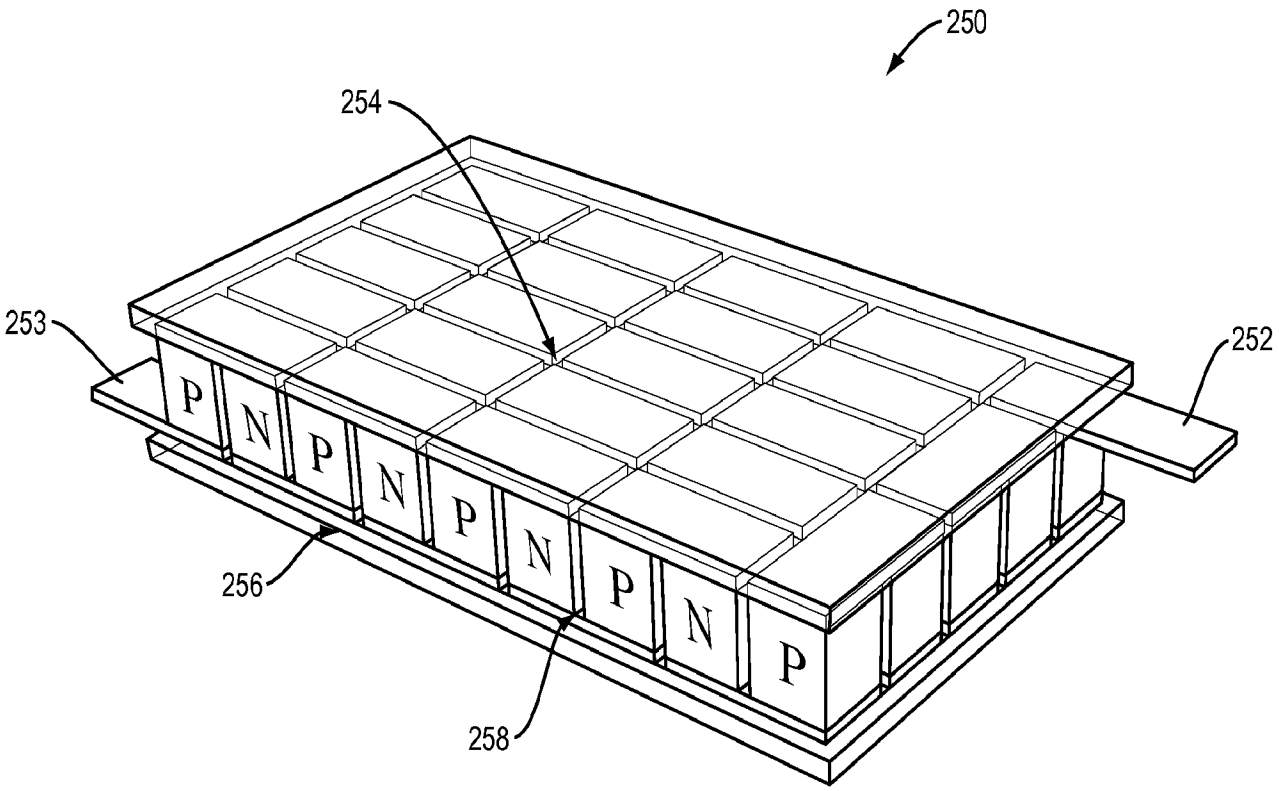
FIG. 8 is a diagrammatic side view of a third embodiment of a heat exchanger of an exemplary beverage chiller of FIG. 1.

With reference to FIG. 8, another embodiment of an exemplary heat exchanger 250, e.g., a thermoelectric heat exchanger, a Peltier device, and the like, for implementation within the heat exchanger section 104 of the beverage chiller 100 is provided. As will be discussed in greater detail below, the heat exchanger 250 includes a structure to transfer heat from the hot beverage. In the embodiment of FIG. 8, the heat exchanger 250 can include a thermoelectric heat exchanger, for example, a Peltier device with the hot beverage flowing on or around the cool side of the Peltier device.

The heat exchanger 250 uses electricity to transfer heat from one side of the heat exchanger 250 to another side of the heat exchanger 250 through the Peltier effect. In particular, the heat exchanger 250 includes a first electrical connection 252, a second electrical connection 253, a hot side 254 and a cold side 256. The heat exchanger 250 further includes an electrical interconnect 258.

The beverage can flow in a hot state near or over the cold side 256. The heat can be transferred from the beverage, through the cold side 256 and into the hot side 254 of the heat exchanger 250. The electrical connection 252 can maintain the cold side 256 at the preferred temperature for cooling the beverage. Once the beverage has been cooled to the desired temperature, the beverage can be dispensed from the heat exchanger 250 in a cooled or chilled state. The heat exchanger 250 generally does not include circulating liquid or moving parts, thereby reducing maintenance required. Thus, the heat exchanger 250 can be implemented in the beverage chiller 100 if the heat exchanger 250 is efficiently operated.

Figure 9:
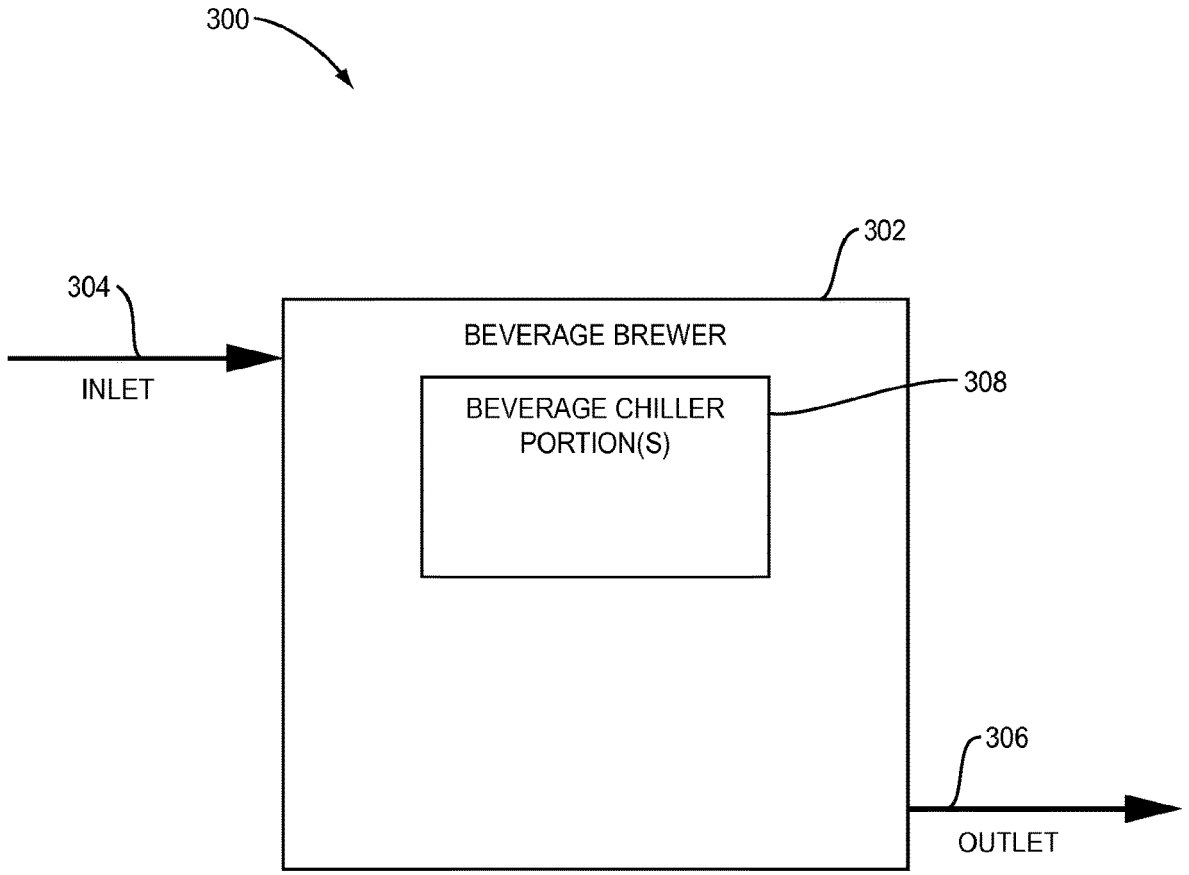
FIG. 9 is a diagrammatic view of an exemplary beverage chiller system according to the present disclosure.

Although illustrated as a free-standing unit which receives a freshly brewed, hot beverage and cools or chills the beverage through a heat exchanger, it should be understood that the beverage chiller 100 (or one or more portions of the beverage chiller 100) can be integrated into a hot beverage brewer. For example, FIG. 9 shows an exemplary beverage chiller system 300. The system 300 includes a beverage brewer 302 which can brew a hot beverage. The system 300 includes an inlet 304 for receiving a fluid, e.g., water, and a brewing medium, e.g., tea leaves, coffee grinds, and the like. The system 300 further includes an outlet 306 from which the brewed beverage can be dispensed.

In some embodiments, the system 300 can be used to brew and dispense a hot beverage. In some embodiments, the system 300 can include one or more portions 308 of the beverage chiller 100 therein. For example, the system 300 can include a heat exchanger within the beverage brewer 302 for cooling the freshly brewed, hot beverage such that a cooled or chilled beverage can be dispensed from the outlet 306. Thus, rather than separately brewing a hot beverage and pouring the hot beverage into the beverage collection section 102, a freshly brewed, iced beverage can be created with a "one-touch" command from a user.

Although discussed herein as implemented for chilled coffee or tea, it should be understood that the beverage chillers and associated systems and methods can be used to cool or chill a variety of hot beverages. In some embodiments, filters can be used to prevent blockages in the beverage chiller due to crystallization of sugar in sugar-based drinks.

The exemplary beverage chillers and associated systems and methods can therefore be used to create a freshly brewed and chilled beverage to a consumer in a timely manner. In particular, a wide variety of beverage types can be brewed upon consumer demand and chilled within a matter of seconds or minutes, resulting in a fresh and chilled beverage.

While exemplary embodiments have been described herein, it is expressly noted that these embodiments should not be construed as limiting, but rather that additions and modifications to what is expressly described herein also are included within the scope of the invention. Moreover, it is to be understood that the features of the various embodiments described herein are not mutually exclusive and can exist in various combinations and permutations, even if such combinations or permutations are not made express herein, without departing from the spirit and scope of the invention.

The invention claimed is:

1. A beverage chiller for chilling a hot beverage, comprising:

a beverage collection section configured to receive a beverage in a hot state, a heat exchanger section configured to chill the beverage from the hot state to a predetermined chilled temperature, the heat exchanger section including an outer housing defining a chamber therein, the heat exchanger section including coiled tubing through which the beverage passes, the coiled tubing extending in a helical manner from a first end at or near a top surface of the heat exchanger section to a second end at or near a bottom surface of the heat exchanger section, a tube vertically disposed within the heat exchanger section for draining overflow of a cooling medium disposed in the heat exchanger section, a dispensing section disposed directly below the heat exchanger section for dispensing the beverage at or near the predetermined chilled temperature, the dispensing section including a base defining a bottom surface of the beverage chiller, the dispensing section including a dispenser housing with a wall defining a cylindrical configuration and having a cutout forming an opening extending into the dispenser housing, and the dispensing section including a spout disposed within the dispenser housing and fluidically connected to the second end of the coiled tubing, a platform disposed within the opening extending into the dispenser housing and configured to receive a container through the opening for receiving the beverage dispensed at or near the predetermined chilled temperature from the spout of the dispensing section, and a drain fitting fluidically coupled to the tube disposed in the heat exchanger section, the drain fitting extending from the bottom surface of the base of the dispensing section, the drain fitting permitting automatic draining of the cooling medium from the heat exchanger section, wherein the beverage collection section, the heat exchanger section and the dispensing section are fluidically connected and vertically stacked in a stacking direction relative to each other.

2. The beverage chiller according to claim 1, wherein the heat exchanger section comprises a removable cover defining the top surface of the heat exchanger section and movable to expose an opening leading into the chamber of the heat exchanger for addition of the cooling medium into the heat exchanger section.

3. The beverage chiller according to claim 1, wherein the beverage collection section comprises a lid for covering and uncovering an opening leading into the beverage collection section for introduction of the beverage in the hot state into the beverage collection section, the beverage collection section is located at or near the top surface of the heat exchanger section, and wherein the beverage collection section comprises a pre-chilling container configured to house the beverage in the hot state.

4. The beverage chiller according to claim 1, wherein the outer housing surrounds the chamber.

5. The beverage chiller according to claim 1, wherein the heat exchanger section comprises a heat exchanger, and wherein the heat exchanger is at least one of an ice bath, a chiller water bath, or a chiller brine bath.

6. The beverage chiller according to claim 5, wherein the condenser is a double-pipe condenser configured to receive refrigerant.

7. The beverage chiller according to claim 5, wherein the first end of the coiled tubing is fluidically connected to the beverage collection section at or near the top surface of the heat exchanger section, and wherein the beverage is introduced in the hot state into the first end of the coiled tubing and the beverage is dispensed at the predetermined chilled temperature to the dispensing section from the second end of the coiled tubing.

8. The beverage chiller according to claim 1, wherein the base of the dispensing section includes a drain for draining at least one of the cooling medium from the heat exchanger section or fluid on the platform of the dispensing section.

9. The beverage chiller according to claim 1, comprising a monitoring device configured to monitor a temperature of the cooling medium within the heat exchanger section.

10. The beverage chiller according to claim 9, comprising an alert section configured to output an alert when the temperature of the cooling medium within the heat exchanger section reaches a predetermined value.

11. The beverage chiller according to claim 1, wherein the heat exchanger section is configured to automatically begin cooling the beverage upon introduction of the beverage into the beverage collection section.

12. The beverage chiller according to claim 1, wherein the dispensing section is configured to automatically dispense the beverage when the beverage reaches the predetermined chilled temperature.

13. The beverage chiller according to claim 1, comprising a sensor disposed within the heat exchanger section, wherein the cooling medium within the heat exchanger section is drained in an automatic manner upon sensing by the sensor that the cooling medium has reached a predetermined temperature.

14. The beverage chiller according to claim 1, comprising a sensor disposed within the heat exchanger section, wherein the cooling medium within the heat exchanger section is drained in an automatic manner upon sensing by the sensor that the cooling medium has reached a predetermined height within the chamber.

15. The beverage chiller according to claim 1, wherein the coiled tubing is a first coiled tubing, and the heat exchanger section includes a second coiled tubing through which the beverage passes, the second coiled tubing extending in a helical manner from the first end at or near the top surface of the heat exchanger section to the second end at or near the bottom surface of the heat exchanger section.

16. The beverage chiller according to claim 1, wherein the drain fitting is dimensioned and positioned to fit within a complementary opening in a countertop on which the beverage chiller is capable of being positioned.

17. The beverage chiller according to claim 1, wherein the beverage collection section comprises a pre-chilling container disposed at or near the top surface of the heat exchanger section, the beverage collection section configured to store the beverage until a user initiates a heat exchange process to chill the beverage from the hot state to the predetermined chilled temperature at the heat exchanger section.

18. A method of chilling a hot beverage, comprising:

providing a beverage chiller, the beverage chiller including (i) a beverage collection section configured to receive a beverage in a hot state, (ii) a heat exchanger section configured to chill the beverage from the hot state to a predetermined chilled temperature, the heat exchanger section including an outer housing defining a chamber therein, the heat exchanger section including coiled tubing through which the beverage passes, the coiled tubing extending in a helical manner from a first end at or near a top surface of the heat exchanger section to a second end at or near a bottom surface of the heat exchanger section, (iii) a tube vertically disposed within the heat exchanger section for draining overflow of a cooling medium disposed in the heat exchanger section, (iv) a dispensing section disposed directly below the heat exchanger section for dispensing the beverage at or near the predetermined chilled temperature, the dispensing section including a base defining a bottom surface of the beverage chiller, the dispensing section including a dispenser housing with a wall defining a cylindrical configuration and having a cutout forming an opening extending into the dispenser housing, and the dispensing section including a spout disposed within the dispenser housing and fluidically connected to the second end of the coiled tubing, (v) a platform disposed within the opening extending into the dispenser housing and configured to receive a container through the opening for receiving the beverage dispensed at or near the predetermined chilled temperature from the spout of the dispensing section, and (vi) a drain fitting fluidically coupled to the tube disposed in the heat exchanger section, the drain fitting extending from the bottom surface of the base of the dispensing section, the drain fitting permitting automatic draining of the cooling medium from the heat exchanger section, the beverage collection section, the heat exchanger section and the dispensing section are fluidically connected and vertically stacked in a stacking direction relative to each other, introducing the beverage in the hot state into the beverage collection section, passing the beverage through the coiled tubing of the heat exchanger section, the beverage being chilled from the hot state to the predetermined chilled temperature during passage through the heat exchanger section, and dispensing the beverage at or near the predetermined chilled temperature at the dispensing section.

19. The method according to claim 18, comprising draining at least a portion of the cooling medium from the heat exchanger section.

20. A beverage chiller system for chilling a hot beverage, comprising:

a brewer for brewing a beverage, a beverage collection section configured to receive the beverage in a hot state, a heat exchanger section configured to chill the beverage from the hot state to a predetermined chilled temperature, the heat exchanger section including an outer housing defining a chamber therein, the heat exchanger section including coiled tubing through which the beverage passes, the coiled tubing extending in a helical manner from a first end at or near a top surface of the heat exchanger section to a second end at or near a bottom surface of the heat exchanger section, a tube vertically disposed within the heat exchanger section for draining overflow of a cooling medium disposed in the heat exchanger section, a dispensing section disposed directly below the heat exchanger section for dispensing the beverage at or near the predetermined chilled temperature, the dispensing section including a base defining a bottom surface of the beverage chiller, the dispensing section including a dispenser housing with a wall defining a cylindrical configuration and having a cutout forming an opening extending into the dispenser housing, and the dispensing section including a spout disposed within the dispenser housing and fluidically connected to the second end of the coiled tubing, a platform disposed within the opening extending into the dispenser housing and configured to receive a container through the opening for receiving the beverage dispensed at or near the predetermined chilled temperature from the spout of the dispensing section, and a drain fitting fluidically coupled to the tube disposed in the heat exchanger section, the drain fitting extending from the bottom surface of the base of the dispensing section, the drain fitting permitting automatic draining of the cooling medium from the heat exchanger section, wherein the brewer dispenses the beverage in the hot state to the beverage collection section, wherein the heat exchanger section chills the beverage from the hot state to the predetermined chilled temperature, and wherein the dispensing section dispenses the beverage at or near the predetermined chilled temperature.

21. The beverage chiller system according to claim 20, wherein the brewer comprises an inlet for receiving a fluid and a brewing medium.

22. The beverage chiller system according to claim 20, wherein the heat exchanger section is disposed within the brewer.

* * * * *